US009877632B2

(12) United States Patent
Roberson et al.

(10) Patent No.: US 9,877,632 B2
(45) Date of Patent: Jan. 30, 2018

(54) STEMWARE HOLDER

(75) Inventors: Lindsay Roberson, Durham, NC (US); Andrew Roberson, Long Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 837 days.

(21) Appl. No.: 13/550,636

(22) Filed: Jul. 17, 2012

(65) Prior Publication Data

US 2014/0021149 A1 Jan. 23, 2014

(51) Int. Cl.
*A47L 15/50* (2006.01)

(52) U.S. Cl.
CPC ..... *A47L 15/505* (2013.01)

(58) Field of Classification Search
CPC ..... A47L 15/505
USPC ..... 211/41.1–41.9, 85.29; 312/228.1; 24/457
See application file for complete search history.

(56) References Cited

U.S. PATENT DOCUMENTS

| | | | | |
|---|---|---|---|---|
| 1,925,540 | A | 9/1933 | Neuschotz | |
| 2,708,037 | A * | 5/1955 | Planeta | 211/74 |
| 3,167,183 | A * | 1/1965 | Claywell et al. | 211/41.2 |
| 3,214,031 | A * | 10/1965 | McCauley | 211/41.2 |
| 3,612,285 | A * | 10/1971 | Mason | 211/41.8 |
| 3,752,322 | A * | 8/1973 | Fiocca et al. | 211/41.8 |
| 4,589,556 | A * | 5/1986 | Peretz | 211/41.9 |
| 4,589,559 | A | 5/1986 | Peretz | |
| 4,927,033 | A * | 5/1990 | Patera et al. | 211/41.9 |
| 5,119,947 | A * | 6/1992 | Stewart | 211/41.2 |
| 6,394,285 | B1 * | 5/2002 | Arthurs et al. | 211/41.9 |
| D518,936 | S | 4/2006 | Yang et al. | |
| 7,556,231 | B2 * | 7/2009 | Herbst et al. | 248/316.1 |
| 7,665,475 | B2 * | 2/2010 | Hedstrom et al. | 134/134 |
| 7,766,175 | B2 * | 8/2010 | Jadhav et al. | 211/41.9 |
| 2007/0039904 | A1 * | 2/2007 | Purushothaman | 211/41.8 |
| 2007/0131696 | A1 * | 6/2007 | Schessl et al. | 220/489 |
| 2008/0185352 | A1 * | 8/2008 | O'Hara | 211/13.1 |
| 2011/0253650 | A1 * | 10/2011 | Renz et al. | 211/41.9 |

OTHER PUBLICATIONS

Chris Jordan/Kenmore, Kenmore Elite, the Dishwasher that Adjusts to Your Needs, 2010, Online: http://notesfromthetrenches.com.
Samsung Electronics Co. Ltd., Samsung DMT800RHS Dishwasher User Manual, Jun. 3, 2010, Online: http://www.samsung.com.

* cited by examiner

*Primary Examiner* — Patrick D Hawn
(74) *Attorney, Agent, or Firm* — Michael E. Tschupp; Andre Pallapies; Brandon G. Braun

(57) ABSTRACT

A stemware holder for a dishwashing rack has a central shaft. The stemware holder also has a holding portion that has a stemware receiving area defined by a first set of prongs and extends from the central shaft in a first direction. The first set of prongs is adapted to hold a portion of a piece of stemware in the receiving area. The stemware holder further has a securing portion that has a dishwasher rack receiving area defined by a second set of prongs and extends from the central shaft in a second direction that is at an angle from the first direction. The second set of prongs is adapted to receive a portion of the dishwasher rack and secure the stemware holder to the dishwashing rack.

33 Claims, 6 Drawing Sheets

STEMWARE HOLDER

FIELD OF THE TECHNOLOGY

The present technology relates to a stemware holder, in particular to a stemware holder for a dishwasher.

BACKGROUND OF THE INVENTION

Typically, a dishwasher contains at least one crockery basket or rack, usually two, each with a number of upstanding tines to hold the crockery in an upright position to allow for maximum cleaning. Occasionally, dishwashers will contain an accessory for separately placing dishware products having a hollow shape, such as wineglasses, in a vertical position to maximize cleaning. However, sometimes the existing tines and/or the accessory are not enough to fully and/or optimally stabilize larger and/or irregular items, in a space conserving manner, in which case such items may not be fully washed/rinsed, may impact the loading/cleaning efficiency of surrounding items or may even be damaged by the cleaning process.

BRIEF SUMMARY OF THE INVENTION

One aspect of the disclosed technology relates to a stemware holder for a dishwasher rack that addresses one or more of the shortcomings of the prior art Another aspect of the disclosed technology relates to a stemware holder for a dishwashing rack that is permanently or detachably connected to the dishwasher rack.

Another aspect of the disclosed technology relates to a stemware holder that holds one or more pieces of stemware at an angle with respect to a side wall of the dishwasher rack. The stemware holder supports the one or more pieces of stemware so that the stemware does not come into contact with, or is spaced away from, a bottom surface of the dishwasher rack.

Another aspect of the disclosed technology relates to a stemware holder that includes a central shaft. The stemware holder also includes a holding portion that has a stemware receiving area defined by a first set of prongs and extends from the central shaft in a first direction. The first set of prongs is adapted to hold a portion of a piece of stemware in the receiving area. The stemware holder further includes a securing portion that has a dishwasher rack receiving area defined by a second set of prongs and extends from the central shaft in a second direction that is at an angle from the first direction. The second set of prongs is adapted to receive a portion of the dishwasher rack and secure the stemware holder to the dishwashing rack.

Another aspect of the disclosed technology relates to a dishwasher rack that includes at least one side wall having an inner surface facing an interior of the rack. The dishwasher rack also includes a stemware holder attached to the at least one side wall. The stemware holder has a central shaft and a holding portion adapted to suspend stemware at an angle with respect to the inner surface of the at least one side wall. The holding portion includes a first set of prongs extending from the central shaft in a first direction.

Another aspect of the disclosed technology relates to a method of securing stemware within a dishwasher. The method includes positioning and orienting the stemware on a dishwasher rack at an angle with respect to an inner surface of a side wall of the dishwasher rack that faces an interior of the dishwasher rack so that the stemware does not contact a bottom surface of the dishwasher rack.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of this technology. In such drawings.

DETAILED DESCRIPTION OF THE INVENTION

The following description is provided in relation to several examples which may share common characteristics and features. It is to be understood that one or more features of any one example may be combinable with one or more features of the other examples. In addition, any single feature or combination of features in any of the examples may constitute additional examples.

Figure 1:
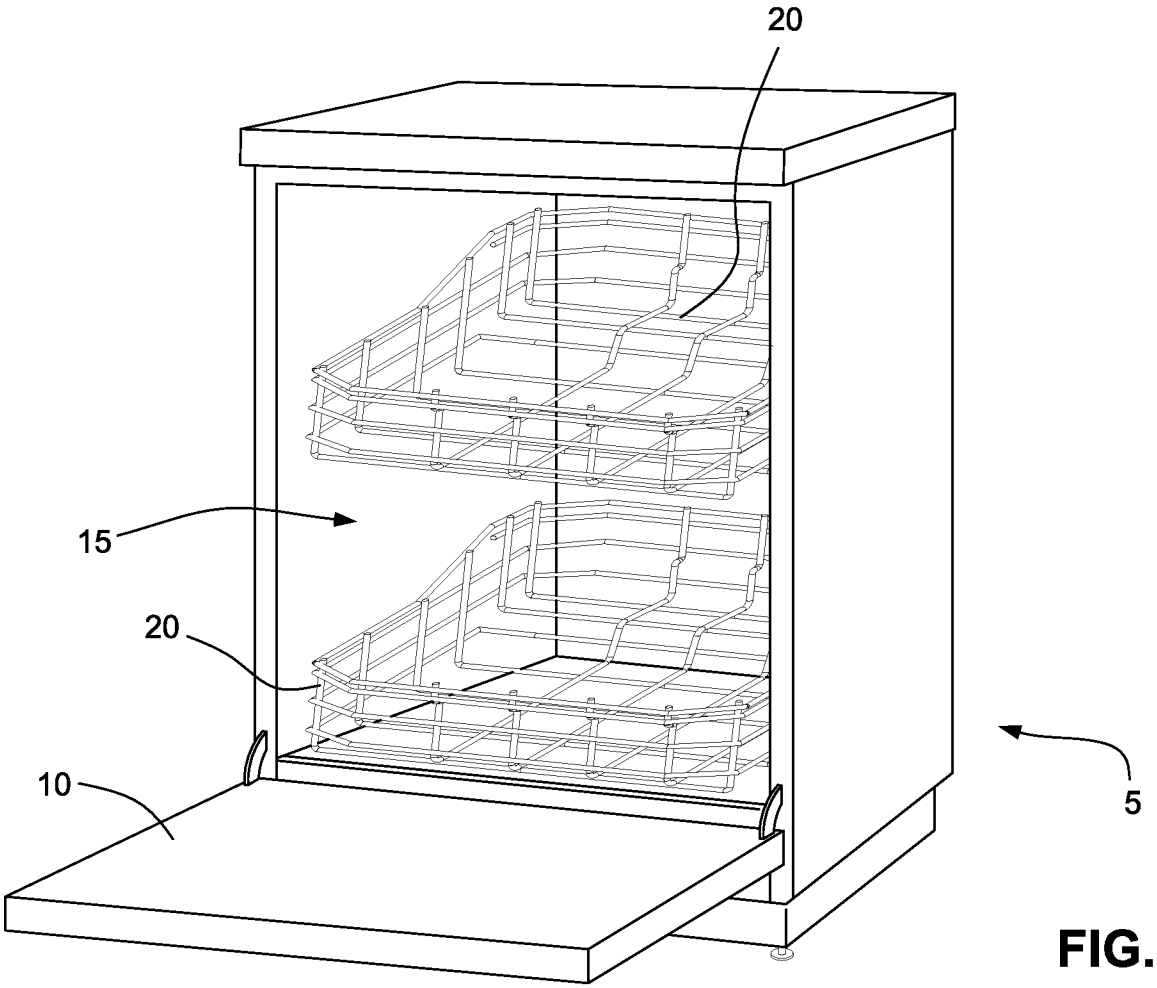
FIG. 1 illustrates an exemplary dishwasher according to an example of the disclosed technology.

FIG. 1 is a schematic view of a dishwasher 5 for washing and/or drying crockery items, such as dishes, frying pans, cookie sheets, cutting boards, bowls, pots, etc., and/or glasses and cups, e.g., wineglasses. The dishwasher 5 may include a manually openable door 10 and a compartment 15. The door 10 may be openable to allow access to the compartment 15. The door 10 may form a generally water/air tight seal relative to the compartment 15 when closed. The compartment 15 may include at least one rack 20.

Figure 2:
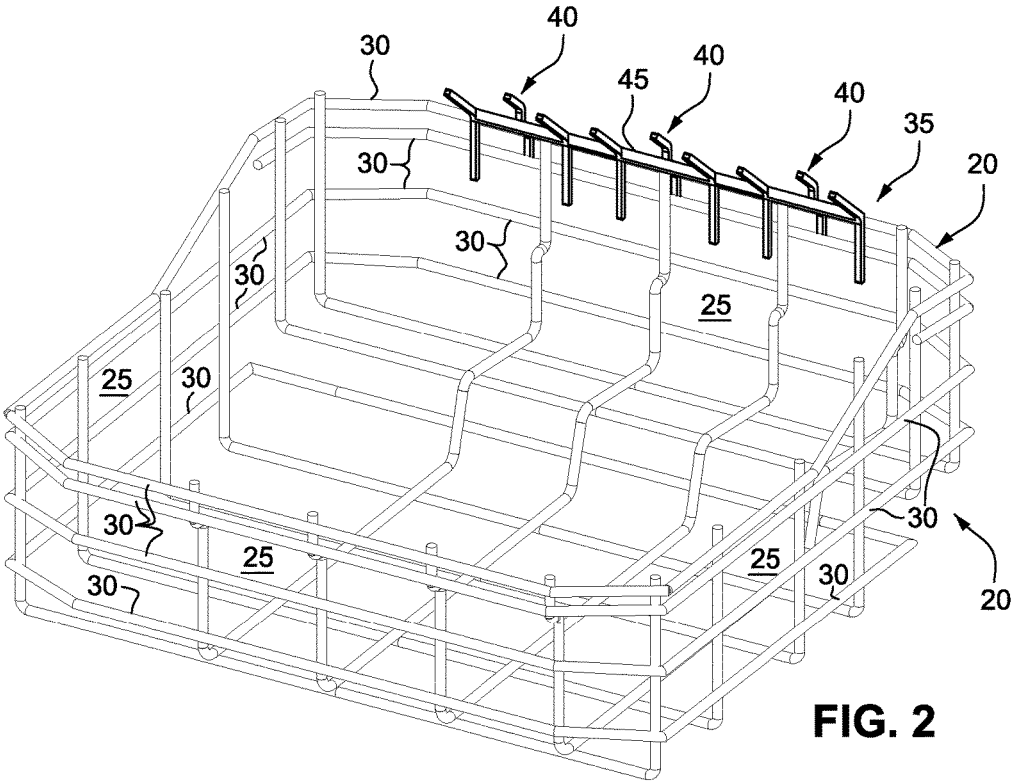
FIG. 2 is a perspective view of a rack of the dishwasher of FIG. 1 with an exemplary stemware holder.

FIG. 2 shows a perspective view of the rack 20. The rack 20 may be any type of rack capable of supporting items that are to be cleaned and/or dried and may be, for example, a wire-type rack. The rack 20 may include side walls 25, which in the case of a wire-type rack, may include one or more horizontally oriented wires 30. In addition, one or more of the side walls 25 (and/or bottom wall) may support one or more stemware holders 35 that securely hold stemware in place within the rack 20. Each of the stemware holders 35 may be permanently or detachably attached to one of the side walls 25 and may include one or more prong units 40 for holding an individual piece of stemware. Each prong unit 40 may be connected to a common central shaft 45.

Figure 3:
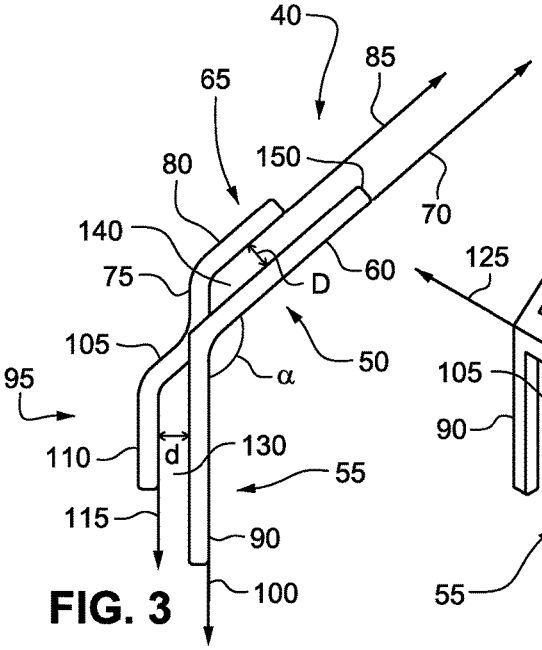
FIG. 3 is a detailed view of a portion of the stemware holder of FIG. 2.
Figure 4:
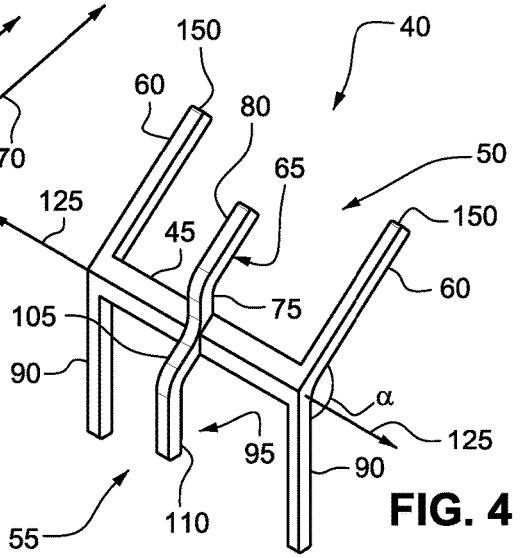
FIG. 4 is another detailed view of the portion of the stemware holder of FIG. 2 from a different perspective.
Figure 5:
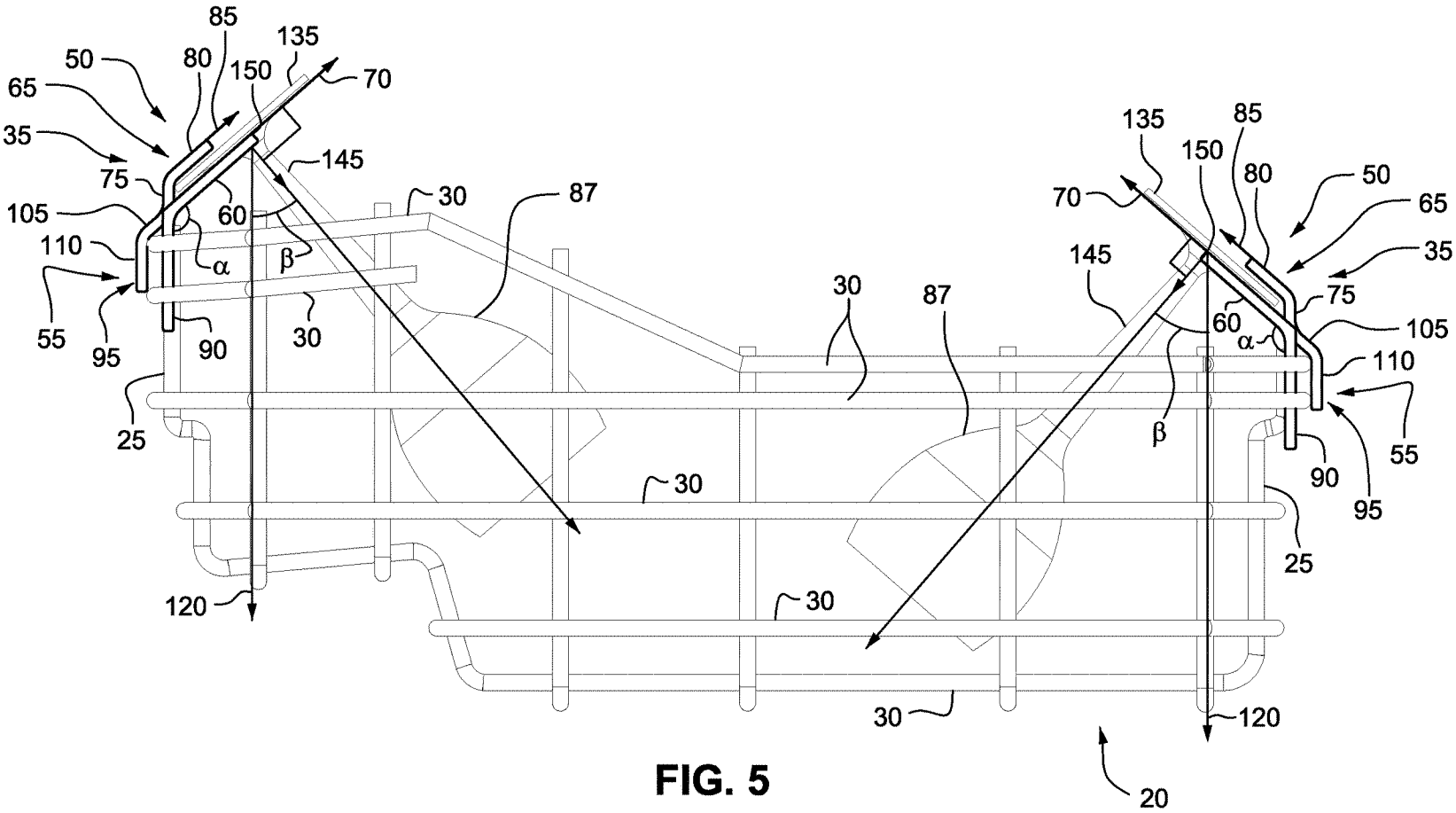
FIG. 5 is a side view of the rack of the dishwasher of FIG. 1 with stemware being held in exemplary stemware holders.

As illustrated in FIGS. 3 and 4, each prong unit 40 may have a holding side 50 for holding a piece of stemware and a securing side 55 for securing the prong unit 40 to the rack 20. The holding side 50 may include two outer holding prongs 60 and an inner holding prong 65 projecting from the central shaft 45. The outer holding prongs 60 may have an unbent shape and may project from the central shaft 45 along a first plane 70. The inner holding prong 65 may be positioned between the outer holding prongs 60 and may have a bent shape. A base portion 75 of the inner holding prong 65 may connect the inner holding prong 65 to the central shaft 45, while an engaging portion 80 of the inner holding prong 65 may extend from the base portion 75. The engaging portion 80 may extend along a second plane 85 that is offset and parallel to the first plane 70. As illustrated in FIG. 5, when the holding side 50 holds a piece of stemware 87, the shaft of the stemware 87 may be perpendicular to first and second planes 70 and 85.

Referring back to FIGS. 3 and 4, the structure of the securing side 55 may mirror the structure of the holding side 50. Accordingly, the securing side 55 may include two outer securing prongs 90 and an inner securing prong 95 projecting from the central shaft 45 and extending away from the holding side 50. Similar to the outer holding prongs 60, the outer securing prongs 90 may have an unbent shape and may project along a third plane 100. The inner securing prong 95 may be positioned between the outer securing prongs 90 and may have a bent shape. A base portion 105 of the inner securing prong 95 may connect the inner securing prong 95 to the central shaft 45, while an engaging portion 110 of the inner securing prong 95 may extend from the base portion 105. The engaging portion 110 may extend along a fourth plane 115 that is offset and parallel to the third plane 100.

The central shaft 45 may be horizontally oriented and may form a core of the stemware holder 35. A single central shaft 45 may form the core of multiple prong units 40 or the core of only one prong unit 40. In addition, the prongs of the holding side 50 and the prongs of the securing side 55 of a particular prong unit 40 may be attached to the central shaft 45 in a manner to form a fixed angle $\alpha$. The angle $\alpha$ may range from 45-175 degrees, and in one example may be any angle greater than about 90 at which the stemware holder 35 may securely hold one or more pieces of stemware 87 (e.g., 105, 120, 135, 150 and 165 degrees). As illustrated in FIG. 5, when secured to the side wall 25, the securing portion 55 may be oriented so that the third and fourth planes 100 and 115 are substantially parallel to a direction in which the side wall 25 extends. Due to the orientation of the prongs on the holding side 50 relative to the prongs on the securing side 55, the stemware holder 35 may hold the stemware 87 at an angle $\beta$ relative to an inner surface of the side wall 25 that faces an interior of the rack 20. In particular, the stemware 87 may form the angle $\beta$ with a plane 120 that is parallel to the inner surface of the side wall 25. In addition, the angle $\beta$ may be less than 90 degrees less, and/or less than the angle $\alpha$. By holding the stemware 87 at the angle $\beta$ and/or appropriately dimensioning the prong unit 40 relative to the size of the stemware 87 and or the rack 20, contact between the stemware 87 and the bottom of the rack 20 may be avoided. Avoiding contact between the stemware 87 and the bottom of the rack 20 may reduce the likelihood damage to the stemware 87 during the cleaning process. Furthermore, suspending the stemware 87 above the bottom of the rack 20 may reduce the likelihood of or prevent the formation of large water spots during the drying process.

Figure 8:
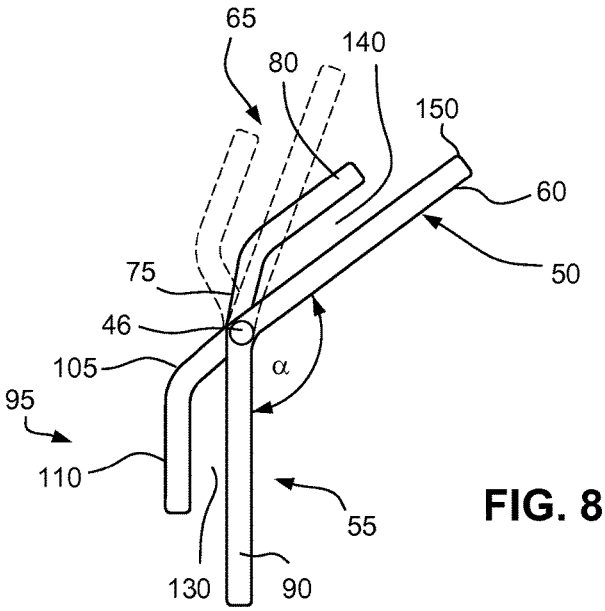
FIG. 8 is a detailed view of a portion of a stemware holder with a hinge.

In an alternate configuration, the central shaft 45 may be a hinge 46 (see FIG. 8) that is rotatable around a central longitudinal axis 125. Accordingly, in this configuration, the angle $\alpha$ (as well as the angle $\beta$) may be variable. The variable angle $\alpha$ (and angle $\beta$) may accommodate stemware of different sizes so that regardless of the size of the stemware 87, the stemware holder 35 may be able to hold the stemware 87 and avoid any contact between the stemware 87 and the bottom surface of the rack 20. In the form of a hinge, the central shaft 45 may be lockable at one or more preset angles within the range of about 45-180 degrees, or about 90 to 180 degrees (e.g., 105, 120, 135, 150 and 165 degrees).

The components of the stemware holder 35 may be made from any material capable of withstanding the conditions inside the dishwasher 5 during cleaning and drying cycles. For example, the components of the stemware holder 35 may be made from the same material as the rack 20. Alternatively, the components of the stemware holder 35 and the rack 20 may be made from different materials. In addition, the holding prongs, securing prongs and the central shaft 45 may be made from the same material, or different materials.

In addition, the stemware holder 35 may be formed integrally to the rack 20 (i.e., the stemware holder 35 may be formed from one piece with the rack 20). Alternatively, the stemware holder 35 may be formed separately from the rack 20 and later permanently or detachably attached to the rack 20. Further, the stemware holder 35 may be retroactively fitted to a conventional dishwasher rack.

As illustrated in FIGS. 2 and 5, the outer securing prongs 90 and the inner securing prong 95 may form a receiving space 130 for receiving the side wall 25 and may operate in concert to secure the stemware holder 35 to the side wall 25. The receiving space 130 may extend in a direction parallel to the plane 100. In addition, a distance d between the outer securing prongs 90 and the engaging portion 110 may substantially correspond to a thickness of the side wall 25 so that the side wall 25 may be tightly received by the receiving space 130, thereby minimizing the movement of the side wall 25 within the stemware holder 35.

When the side wall 25 is received by the stemware holder 35, the base portion 105 of the inner securing prong 95 may contact an upper surface of the side wall 25. Accordingly, the base portion 105 may be the portion of the stemware holder 35 that rests on the side wall 25 when the stemware holder 35 is attached to the side wall 25. However, because the base portion 105 may be offset from the center of mass (the central shaft 45) of the stemware holder 35 and may be offset from the center of mass of the stemware 87 being held by the stemware holder 35, the stemware holder 35 may have a tendency to rotate around the contact point between the upper side of the side wall 25 and the base portion 105. This rotational tendency may cause the outer securing prongs 90 to be forced against the side wall 25. A length of the outer securing prongs 90 may be selected so that the outer securing prongs 90 may use the side wall 25 to resist any rotational movement of the stemware holder 35. For example, when the rack 20 is a wire rack, the length of the outer securing prongs 90 may be selected so that the outer securing prongs 90 may engage at least two horizontal wires 30. In addition, a length of the engaging portion 110 may be sized to prevent the side wall 25 from slipping out of the receiving space 130.

Figure 9:
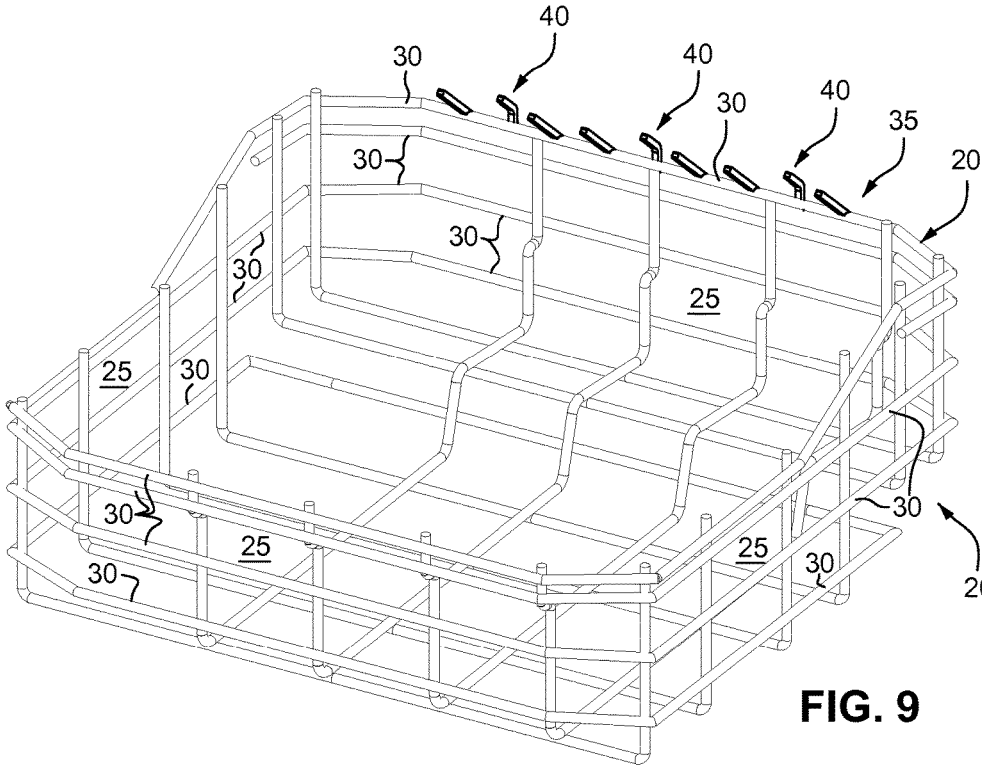
FIG. 9 is a perspective view of a rack of the dishwasher of FIG. 1 with an integral stemware holder.

In an alternate embodiment, the securing side 55 of the stemware holder 35 may be omitted and the central shaft 45 may be secured to the side wall 25. In examples omitting the securing side 55, the central 45 may be secured to the side wall 25 via, for example, a weld, an adhesive, mechanical fasteners or any other method or device capable of withstanding the conditions encountered during the cleaning and drying cycles of the dishwasher. Also, instead of being secured to the side wall 25, the central shaft 45 may be a part of the side wall 25. For example, in an embodiment in which the rack 20 is a wire rack, the central shaft 45 may be an uppermost horizontally oriented wire 30 (see FIG. 9). It should be understood that all configurations omitting the securing side 55 may or may not include a hinge as the central shaft 45. In other words, for all configurations without the securing side 55, the angle α (and the angle β) may be fixed or variable.

Figure 6:
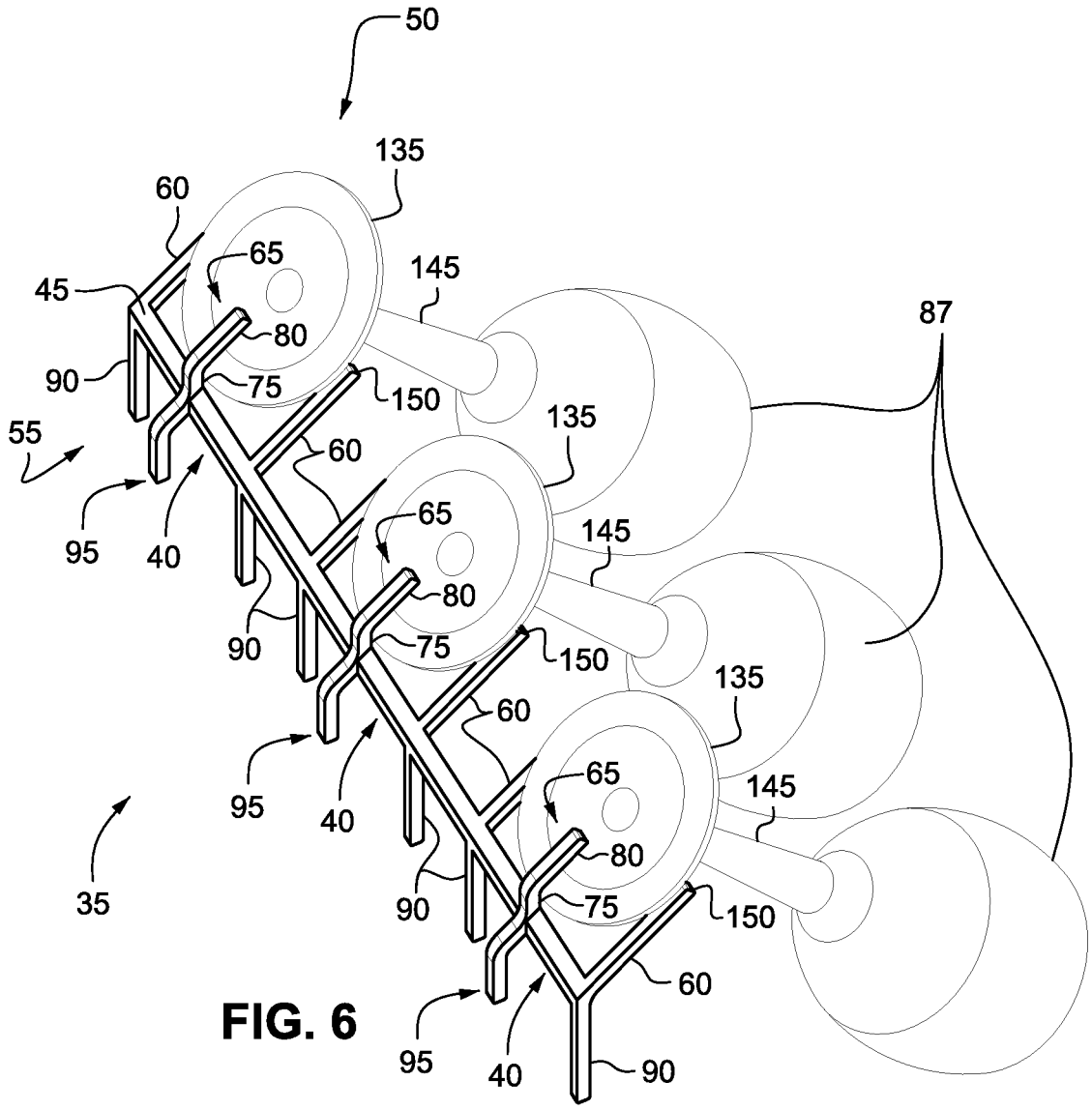
FIG. 6 is a perspective view of an exemplary stemware holder holding stemware.
Figure 7:
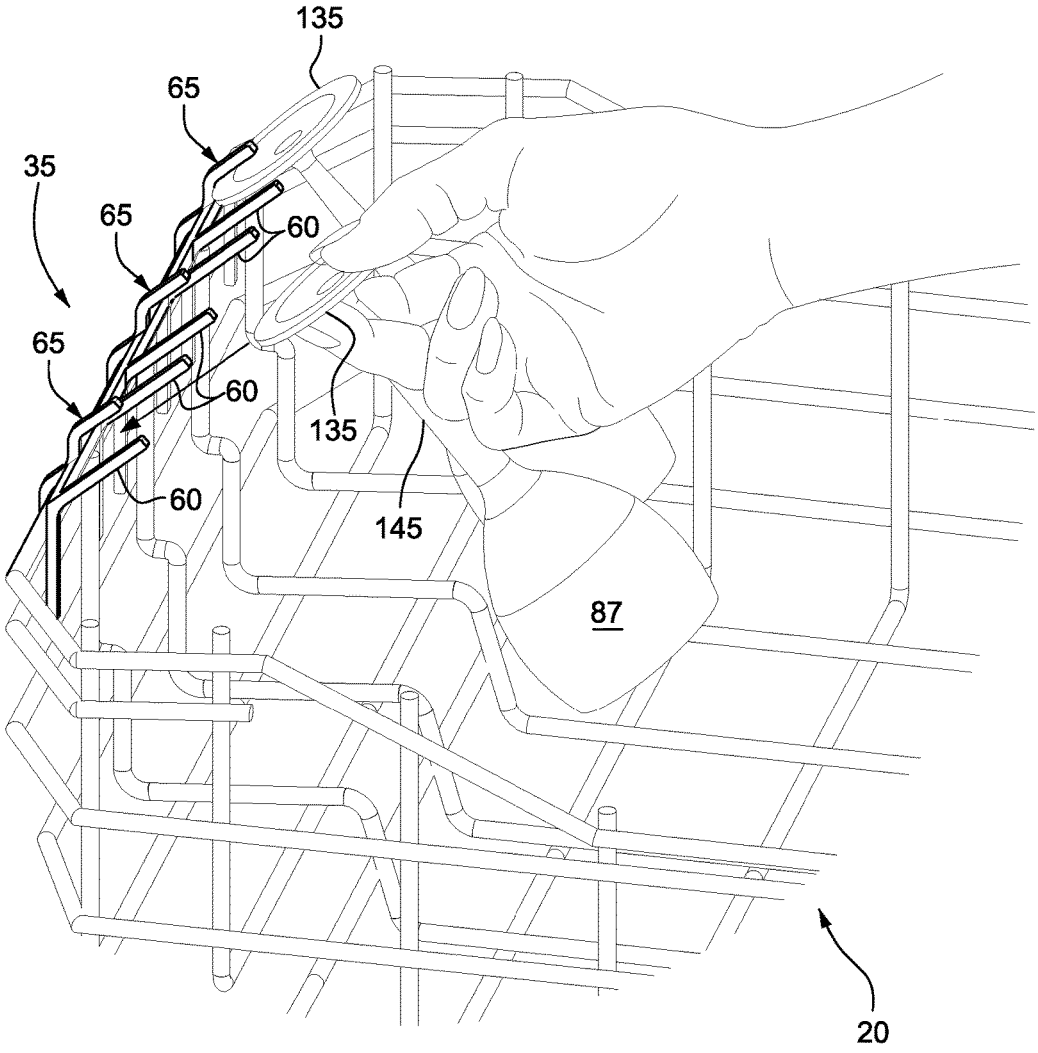
FIG. 7 illustrates a method for inserting stemware into an exemplary stemware holder.

As illustrated in FIGS. 5-7, the holding side 50 of the stemware holder 35 may receive a base 135 of a piece of stemware 87. The base 135 may be received by a receiving space 140 defined by the outer holding prongs 60 and the inner holding prong 65. The receiving space 140 may extend in a direction parallel to the plane 70. In addition, a distance D between the outer holding prongs 60 and the engaging portion 80 may substantially correspond to a thickness of the base 135 so that the base 135 may be tightly received by the receiving space 140, thereby minimizing the movement of the base 135 within the stemware holder 35.

Upon receiving the stemware 87, the outer holding prongs 60 may support the stemware 87. A distance between the outer holding prongs 60 may be wide enough to allow a stem 145 of the stemware 87 to pass between the outer holding prongs 60. At the same time, the distance between the outer holding prongs 60 may be smaller than a diameter of the base 135 so that the base may not slip between the outer holding prongs 60.

Because the outer holding prongs 65 may support the stemware 87 at the angle β, and because the stemware 87 may be supported so that the stemware 87 does not rest on the bottom of the rack 20, the stemware 87 may have a tendency to rotate around an axis passing through distal ends 150 of the outer holding prongs 65 and may fall off of the outer holding prongs 65. The engaging portion 80 of the inner holding prong 65 may be positioned anywhere between the outer holding prongs 65 that may enable the engaging portion 80 to counteract the rotating tendency of the stemware 87 and retain the stemware 87 within the receiving space 140. For example, the inner holding prong 60 may be positioned at a location corresponding to the stem 145 of the stemware 87. In addition, the base portion 75 of the inner holding prong 65 may form a barrier against which the base 135 of the stemware 87 may rest.

While the technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the disclosure.

What is claimed is:

1. A stemware holder for a dishwashing rack, the stemware holder comprising:

a central shaft;

a holding portion including a stemware receiving space defined by a first set of prongs and extending from the central shaft in a first direction, the first set of prongs being adapted to hold a portion of a piece of stemware in the receiving space; and a securing portion including a dishwasher rack receiving space defined by a second set of prongs and extending from the central shaft in a second direction that is at an angle from the first direction, the second set of prongs being adapted to receive a portion of the dishwasher rack and secure the stemware holder to the dishwashing rack, wherein the holding portion is configured to hold the piece of stemware at an inclined orientation when the stemware holder is secured to the dishwasher rack.

2. The stemware holder of claim 1, wherein an angle between the first direction and the second direction is less than or greater than 90 degrees.

3. The stemware holder of claim 1, wherein the first set of prongs includes a first pair of outer prongs and a first inner prong offset from and between the first pair of outer prongs.

4. The stemware holder of claim 3, wherein the second set of prongs includes a second pair of outer prongs and a second inner prong offset from and between the second pair of outer prongs.

5. The stemware holder of claim 4, wherein the holding portion mirrors the securing portion.

6. The stemware holder of claim 4, wherein the first pair of outer prongs, the first inner prong, the second pair of outer prongs and the second inner prong forms a prong unit adapted to hold a single piece of stemware.

7. The stemware holder of claim 6, wherein the central shaft is attached to a plurality of prong units.

8. The stemware holder of claim 6, wherein only one prong unit is attached to the central shaft.

9. The stemware holder of claim 1, wherein the central shaft is a hinge, and the first and second sets of prongs are rotatable around the central shaft.

10. The stemware holder of claim 9, wherein the angle between the first and second directions is variable.

11. The stemware holder of claim 1, wherein the angle between the first and second directions is fixed.

12. The stemware holder of claim 1, wherein the prongs and the central shaft are formed from the same material.

13. The stemware holder of claim 1, wherein the prongs and the central shaft are formed from different materials.

14. A dishwasher rack comprising:

at least one side wall having an inner surface facing an interior of the rack; and a stemware holder according to claim 1 that is attached to the at least one side wall.

15. The stemware holder of claim 1, wherein in the inclined orientation, the stemware is orientated at an angle relative to a vertical plane, the angle being within a range of about 45-75 degrees.

16. The stemware holder of claim 1, wherein the holding portion is configured to hold the piece of stemware away from a bottom of the dishwasher rack.

17. A dishwasher rack comprising:

at least one side wall having an inner surface facing an interior of the rack; and a stemware holder attached to the at least one side wall, the stemware holder comprising:

a central shaft; and a holding portion adapted to suspend stemware at a non-zero angle with respect to a vertical plane, the holding portion including a first set of prongs extending from the central shaft in a first direction, wherein in the non-zero angle is within a range of about 45-75 degrees.

18. The dishwasher rack of claim 17, wherein the first set of prongs define a stemware receiving space that extends in the first direction and is adapted to receive a portion of a piece of stemware.

19. The dishwasher rack of claim 17, wherein the stemware holder is permanently attached to the side wall.

20. The dishwasher rack of claim 19, wherein the stemware holder is formed from one piece with the side wall.

21. The dishwasher rack of claim 17, wherein the central shaft is an upper part of the side wall.

22. The dishwasher rack of claim 21, wherein the dishwasher rack is a wire rack and the central shaft is an uppermost horizontally oriented wire of the side wall.

23. The dishwasher rack of claim 19, wherein the central shaft is a hinge, and the first set of prongs is rotatable around the central shaft.

24. The dishwasher rack of claim 23, wherein the angle between the first direction and the inner surface is variable.

25. The dishwasher rack of claim 17, wherein the angle between the first direction and the inner surface is fixed.

26. A dishwasher comprising:

the dishwasher rack of claim 17.

27. The dishwasher rack of claim 17, wherein the holding portion is configured to suspend the stemware above a bottom of the dishwasher rack.

28. A dishwasher rack comprising:

at least one side wall having an inner surface facing an interior of the rack; and a stemware holder attached to the at least one side wall, the stemware holder comprising:

a central shaft; and a holding portion adapted to suspend stemware at a non-zero angle with respect to a vertical plane, the holding portion including a first set of prongs extending from the central shaft in a first direction, wherein the stemware holder is removably attached to the side wall.

29. The dishwasher rack of claim 28, wherein the stemware holder further comprises a securing portion that engages the side wall and includes a second set of prongs that extend in a second direction.

30. The dishwasher rack of claim 29, wherein the holding portion mirrors the securing portion.

31. The dishwasher rack of claim 30, wherein the first set of prongs includes a first pair of outer prongs and a first inner prong offset from and between the first pair of outer prongs and the second set of prongs includes a second pair of outer prongs and a second inner prong offset from and between the second pair of outer prongs.

32. A dishwasher comprising:

a dishwashing rack with a bottom surface and at least one side wall extending from the bottom surface, the at least one side wall having an inner surface facing an interior of the rack;

a stemware holder attached to the dishwashing rack and configured to suspend a piece of stemware at a particular orientation so that the piece of stemware does not contact the bottom surface; and a washing compartment configured to house the dishwashing rack and the stemware holder, the washing compartment having a side wall, wherein in the particular orientation, the stemware is suspended at a non-zero angle with respect to the sidewall of the compartment, wherein the non-zero angle is less than 90 degrees, wherein the stemware holder includes a pair of outer prongs and an inner prong that is offset from and between the pair of outer prongs, the outer prongs being configured to support the piece of stemware, and wherein the stemware holder is removably attachable to the dishwashing rack.

33. A dishwasher comprising:

a dishwashing rack with a bottom surface and at least one side wall extending from the bottom surface, the at least one side wall having an inner surface facing an interior of the rack;

a stemware holder attached to the dishwashing rack and configured to suspend a piece of stemware at a particular orientation so that the piece of stemware does not contact the bottom surface; and a washing compartment configured to house the dishwashing rack and the stemware holder, the washing compartment having a side wall, wherein in the particular orientation, the stemware is suspended at a non-zero angle with respect to the sidewall of the compartment, wherein in the non-zero angle is within a range of about 45-75 degrees.

* * * * *